US009899731B1

(12) United States Patent
Klein

(10) Patent No.: US 9,899,731 B1
(45) Date of Patent: Feb. 20, 2018

(54) OCTOFILAR ANTENNA

(71) Applicant: AEROANTENNA TECHNOLOGY, INC., Chatsworth, CA (US)

(72) Inventor: Joseph Klein, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 0 days.

(21) Appl. No.: 15/256,891

(22) Filed: Sep. 6, 2016

(51) Int. Cl.

| | |
|---|---|
| ***H01Q 1/36*** | (2006.01) |
| ***H01Q 11/08*** | (2006.01) |
| ***H01Q 1/48*** | (2006.01) |
| *H01Q 9/27* | (2006.01) |
| *H01Q 1/38* | (2006.01) |

(52) U.S. Cl.
CPC ..... *H01Q 1/36* (2013.01); *H01Q 1/48* (2013.01); *H01Q 1/362* (2013.01); *H01Q 1/38* (2013.01); *H01Q 9/27* (2013.01); *H01Q 11/08* (2013.01)

(58) Field of Classification Search
CPC ..... H01Q 1/362; H01Q 1/36; H01Q 1/38; H01Q 11/08; H01Q 9/27
USPC ..... 343/895
See application file for complete search history.

(56) References Cited

U.S. PATENT DOCUMENTS

| | | | | | |
|---|---|---|---|---|---|
| 3,906,509 | A | | 9/1975 | DuHamel | |
| 5,134,422 | A | | 7/1992 | Auriol | |
| 5,828,348 | A | * | 10/1998 | Tassoudji | H01Q 11/08 343/853 |
| 5,986,619 | A | * | 11/1999 | Grybos | H01Q 1/288 343/853 |
| 6,075,501 | A | * | 6/2000 | Kuramoto | H01Q 11/08 343/853 |
| 6,133,891 | A | * | 10/2000 | Josypenko | H01Q 1/362 343/860 |
| 6,407,720 | B1 | * | 6/2002 | Josypenko | H01Q 11/08 343/895 |
| 6,653,987 | B1 | * | 11/2003 | Lamensdorf | H01Q 1/38 343/853 |
| 2004/0008153 | A1 | * | 1/2004 | Lamensdorf | H01Q 1/362 343/895 |
| 2006/0022891 | A1 | * | 2/2006 | O'Neill, Jr. | H01Q 11/08 343/895 |
| 2008/0094307 | A1 | * | 4/2008 | Cowles | H01Q 1/08 343/895 |
| 2011/0001680 | A1 | * | 1/2011 | Leisten | H01Q 11/08 343/859 |

(Continued)

FOREIGN PATENT DOCUMENTS

| | | | |
|---|---|---|---|
| WO | WO9711507 | * | 3/1997 |

OTHER PUBLICATIONS

Investigation of an octafilar helix antenna, by Zainud et al., Aug. 2002.*

(Continued)

*Primary Examiner* — Hoang Nguyen
*Assistant Examiner* — Awat Salih
(74) *Attorney, Agent, or Firm* — McNair Law Firm, P.A.

(57) ABSTRACT

The present invention is an octofilar antenna formed by adding four grounded parasitic arms in between the arms of a conventional air core quadrifilar antenna to negate the problems of mis-matching and strong mutual coupling for quarter-wave small helices. The invention ultra compact air core helix antenna does not suffer from typical dielectric loading effects.

11 Claims, 5 Drawing Sheets

(56) References Cited

U.S. PATENT DOCUMENTS

| | | | | |
|---|---|---|---|---|
| 2011/0254755 | A1* | 10/2011 | DiNallo | H01Q 11/08 343/893 |
| 2012/0133568 | A1* | 5/2012 | Lafleur | H01Q 1/362 343/833 |
| 2013/0035044 | A1* | 2/2013 | DiNallo | H01Q 1/36 455/77 |
| 2017/0062917 | A1* | 3/2017 | Hyjazie | H01Q 1/362 |

OTHER PUBLICATIONS

Octafilar Helical Antenna for Handheld UHF RFID Reader, by Zainud et al., Apr. 2011.*

* cited by examiner

OCTOFILAR ANTENNA

FIELD OF THE INVENTION

The present invention relates to an antenna having a multi-filar construction.

BACKGROUND OF THE INVENTION

Most antennas for satellite communication systems require circular polarization with a good axial ratio, large frequency bandwidth and low cost. Quadrifilar Helical Antennas (QHA) have been extensively used since they are well suited for such applications as they have good axial ratio good over a broadband. In particular, they are preferred over patch antennas for handset applications where helices show better multipath rejection in the absence of large ground planes.

One of the primary design goals for handset applications is reducing the size of the antenna. For helix antennas, the reduction in size can be reducing the height or radius of the helix.

Various techniques are proposed in the literature to reduce the height of helix antennas, ranging from meanders to sinusoidal profiles. These techniques are mostly applied to antennas with radial or iso-flux patterns, whose height may be between one and two wavelengths thus demanding for some reduction. Size reductions up to 50% are reported with acceptable gain degradation. The main problem is that the length of each arm should be an odd quarter wave length multiple (i.e. $n\lambda/4$, n=1, 3, 5 . . . ) for open ended arms or even quarter wave length multiple for short ended helices. (FIG. 1). The shortest quadrifilar helix has arms with arm length equal to quarter wavelength ($\lambda g/4$). However, the impedance of the antenna at this resonance is small and makes it difficult to match. The conventional length for quadrifilar helix arms is ($\lambda g/2$). Therefore, a conventional way to miniaturize a helix antenna is to load it with materials with high dielectric constants which results in gain reduction and narrowband performance. Furthermore, reducing the radius of the helix also raises several problems. The most important one is that, the mutual coupling between adjacent ports increases rapidly as the helix radius becomes smaller. This eventually results in energy coupling between ports and not radiating from the antenna.

SUMMARY OF THE INVENTION

The present invention adds four grounded parasitic arms in between the arms of a conventional air core quadrifilar antenna to negate the problems of mis-matching and strong mutual coupling for quarter-wave small helices. The invention, ultra compact air core helix antenna does not suffer from typical dielectric loading effects. A grounded parasitic element is helically located essentially equidistant between two adjacent radiating helix arms to form the invention octofilar structure.

DETAILED DESCRIPTION OF THE INVENTION

The invention is now discussed with reference to the figures.

Figure 1:
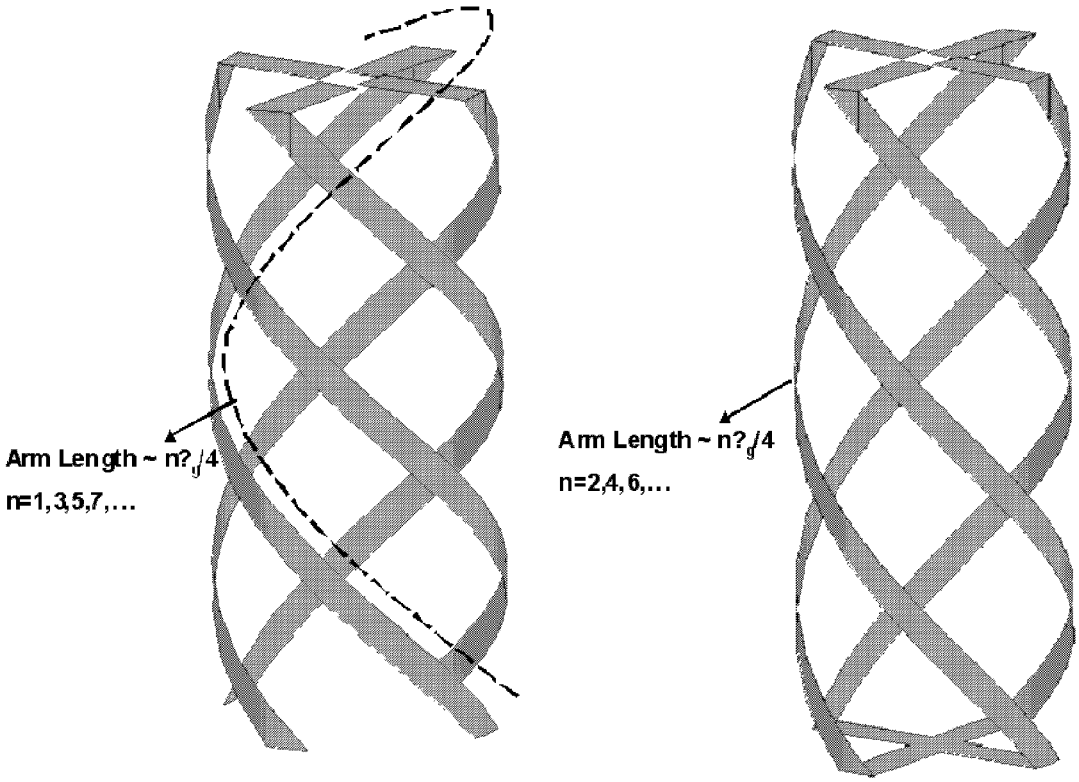
FIG. 1 PRIOR ART
FIG. 1 is a side view of two prior art quadrifilar helix antennas with respectively short or open ends.
Figure 2:
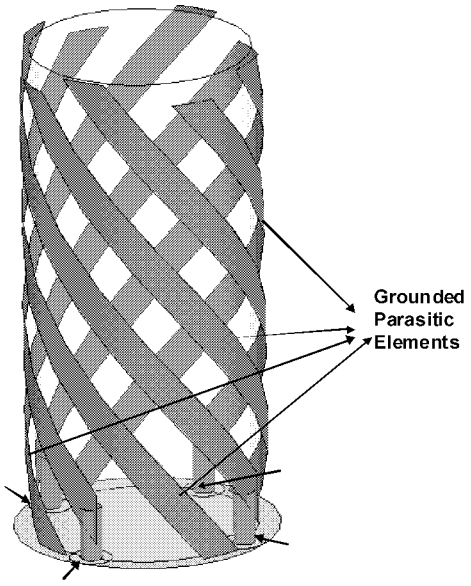
FIG. 2 is a side view of the invention octafilar helix antenna (OHA) with grounded parasitic elements.
Figure 3:
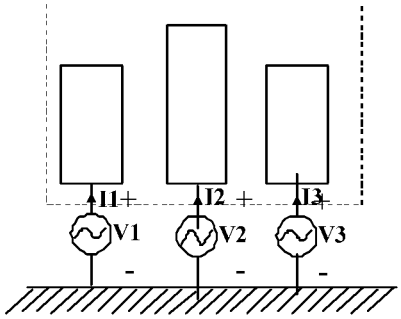
FIG. 3 is a circuit diagram of the invention octafilar antenna for three radiating elements (a main arm and two parasitics adjacent) elements for a three-port microwave network.

FIG. 2 shows an octafilar helix antenna (OHA) comprising of four arms feed at (F1, F2, F3 and F4) locations with excitation coefficients of equal amplitude and (0, 90, 180 and 270) phase shift to generate circularly polarized radiation patterns. There are also four grounded arms placed in between the main arms to mutually interact with them and change the reflection coefficient of each feeding ports. This concept is briefly explained here:

Consider an arm of a quadrifilar helix and its adjacent parasitic elements as a three-port network shown in FIG. 3, the relation between voltage and currents of this three port network can be expressed as $$\begin{cases} V_1 = Z_{11}I_1 + Z_{12}I_2 + Z_{13}I_3 \\ V_2 = Z_{21}I_1 + Z_{22}I_2 + Z_{23}I_3 \\ V_3 = Z_{31}I_1 + Z_{32}I_2 + Z_{33}I_3 \end{cases} \tag{1}$$

If the parasitic element is grounded then V1=V3=0 and the impedance of the port 2 can be calculated as $$Z_2 = \frac{V_2}{I_2}\Big|_{V_1=V_3=0} = Z_{22} + \frac{Z_{13}Z_{32} - Z_{12}Z_{33}}{Z_{11}Z_{33} - Z_{13}Z_{31}}Z_{21} + \frac{Z_{23}Z_{31} - Z_{11}Z_{32}}{Z_{11}Z_{33} - Z_{13}Z_{31}}Z_{23} \tag{2}$$

For the case of a helix arm with two adjacent grounded parasitic elements, equation (2) can be simplified using the symmetry of the structure and reciprocity properties. Assuming identical parasitic elements located symmetrical with respect to main arm, one c an assume that (Z12=Z21=Z23=Z33, Z11=Z33). Under these assumptions, equation 2) will be reduced to $$Z_2 = \frac{V_2}{I_2}\Bigg|_{\substack{V_1=V_3=0 \\ Z_{12}=Z_{21}=Z_{23}=Z_{32} \\ Z_{11}=Z_{33} \\ Z_{13}=Z_{31}}} = Z_{22} - \frac{2Z_{12}^2}{Z_{11} + Z_{13}} \tag{3}$$

It can be observed by adjusting the second term in equation 3 one can match the main element impedance. For case of helix antenna this is achieved by adjusting the length of the grounded element. In addition, simulation and measured results show that these parasitic grounded elements reduce the mutual coupling between adjacent main elements as well.

Figure 4A:
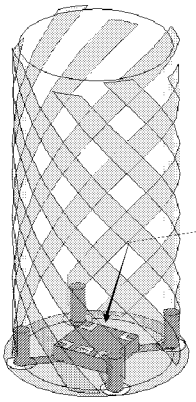
FIGS. 4*a*, 4*b* and 4*c* are respectively a side and partly transparent view, top view of and a side view of the invention LTCC 4-way coupler used to feed different types of the octafilar helix antennas.
Figure 4B:
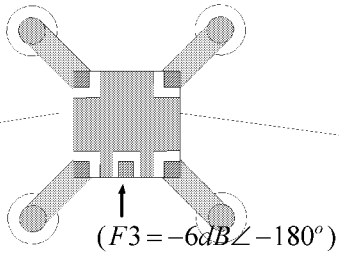
Figure 4C:
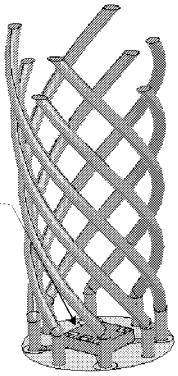

The helix arms can be printed on a foldable thin printed circuit board. Alternatively, the arms can be built from wires shaped accordingly as shown in FIG. 5. The main arms should be fed by input signals with equal amplitude and quadrature phase difference. This network can be realized using various techniques. For helices with fairly large diameter, the feeding network can be located on ground plane. A typical design is to use two baluns and an LTCC (Low Temperature Cofired Ceramic) 90-hybrid coupler. In this case, an LTCC 4-way coupler was used which provides four signals with quadrature phase difference (FIGS. 4*a*, 4*b* and 4*c*).

Figure 5A:
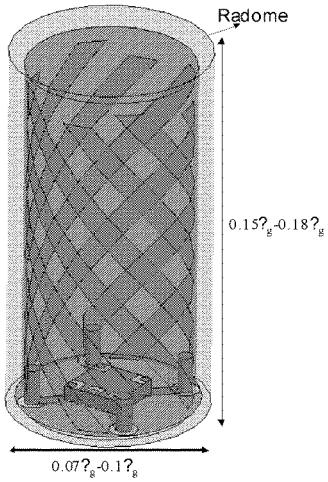
FIGS. 5*a* and 5*b* are respectively aside and partly transparent view of the invention octafilar helix antenna assembled unit and a side view of its printed helix circuit shown on a flat circuit board.
Figure 5B:
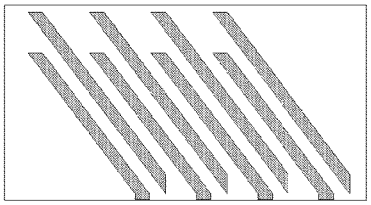

FIGS. 5*a* and 5*b* show a surface of the printable helix antenna and assembled unit with typical sizes for most satellite communication applications in operating wavelength. For most cases, helix arm pitch is in range of (40 degrees-60 degrees) and a fraction of (0.5-0.7) turn is required. As it can be observed, these dimensions are much smaller than typical conventional quadrifilar helices where the arms of helices are at least half a wavelength in length and 0.3λ-0.4λ.

Figure 6:
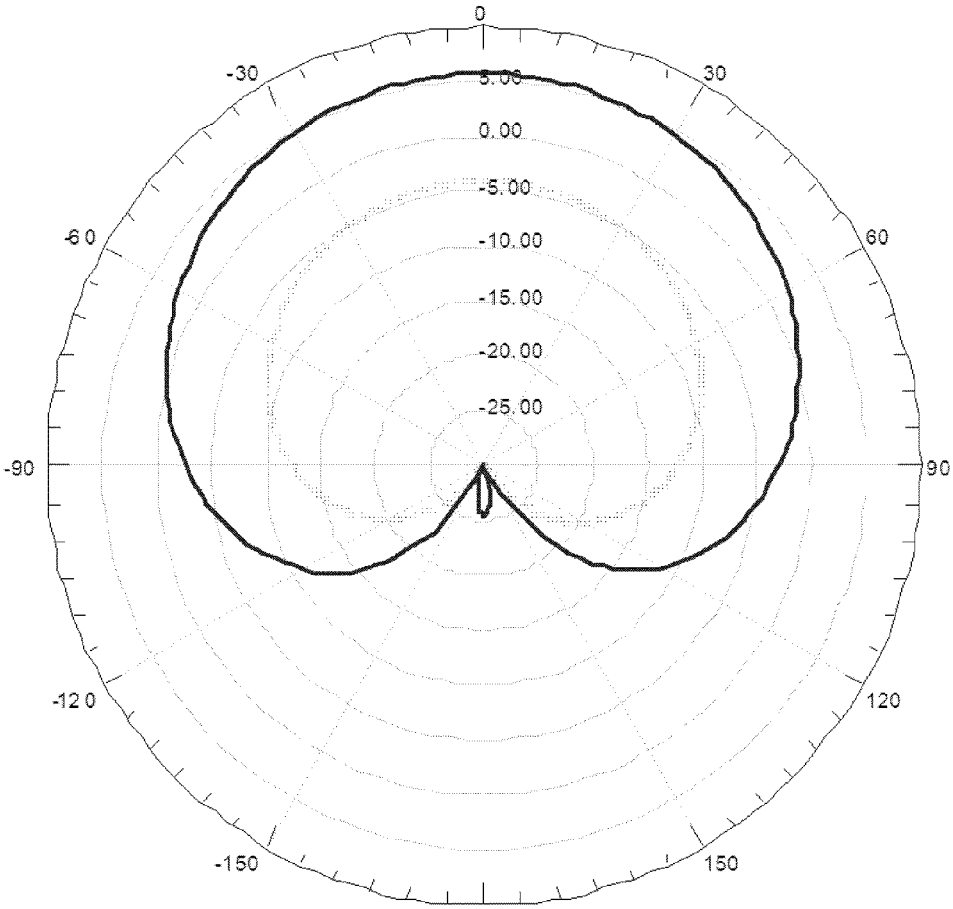
FIG. 6 is a graph of the gain comparison in dB between performance of the invention octafilar antenna and a prior art quadrifilar helix with same dimensions.

In order to show the improvement of octafilar helix over quadrifilar helix with same structure, the performance of two helices compared in FIG. 6. Both antennas have same structure except the absence of parasitic element for quadrifilar helix. The results show an evident improvement in performance of the antenna by suppressing the mutual coupling between adjacent arms and increasing the antenna gain.

Figures 7A, 7B:
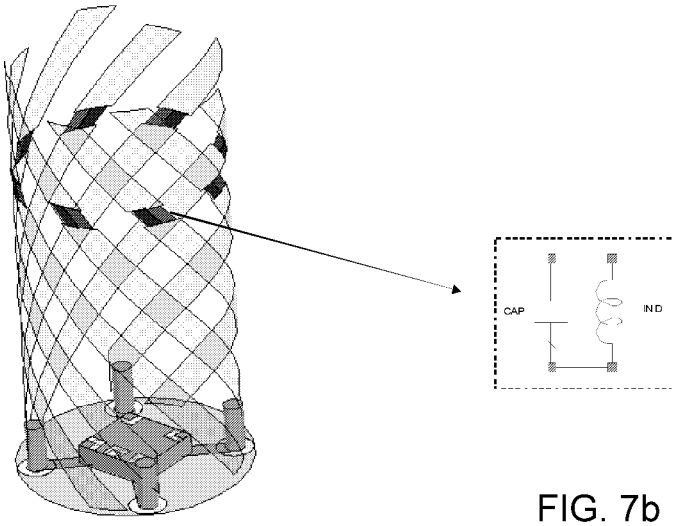
FIGS. 7*a* and 7*b* are respectively a side and partly transparent view of an invention dual-band octafilar helix antenna with embedded circuit elements, showing a small exposed section of two adjacent conductors, and a representative circuit diagram.

The same idea can be used for dual band applications where a parallel LC circuit can be implemented on each arm (main and parasitic) to open up the line at LC resonant and make the effective length of each arm shorter as shown in FIGS. 7*a* and 7*b*. The length is chosen for resonant operation at the lower frequency band. To provide resonant operation at the higher frequency band, a switch is placed at an appropriate location in each arm. At the lower frequency, the switch is open. At high frequency the switch is close and the effective length of the antenna, is shorter.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

The invention more generally comprises an ultra compact octafilar air core helix antenna comprising four radiating helix arms and four grounded parasitic elements in between. In addition, this ultra compact octafilar air core helix can be used for dual band applications by adding adjacent passive circuit elements on the helical arms. The helix can be printed on a foldable printed circuit board or be built from wire. The radiating elements will be fed with four inputs with same amplitude and appropriate quadrature phase difference (0, 90 180 and 270). A 4-way LTCC hybrid was used in this invention. The invention additionally comprises a method of suppressing mutual coupling between helix arms by placing grounding parasitic elements.

I claim:

1. An octafilar air core helix antenna comprising: four radiating helix arms and four grounded parasitic elements, which together define an internal cylindrical space, where each helix arm and each parasitic element comprise an origin point located on a periphery of a round base plate so that each alternating origin point of a helix arm and parasitic element are equidistant from adjacent origin points, whereby each helix arm and parasitic element extend upward and helically from the base plate maintaining equidistant space between them, wherein each of the helix arms and parasitic elements comprise an electric circuit switch intersecting and electrically connecting the lengths of the helix arms and parasitic elements at the same elevation from the base plate, so that a lower frequency band fed to the helix arms is prevented from radiating from the helix arms above the electric circuit switch.

2. The antenna of claim 1 wherein the parasitic elements are connected to a ground at the base plate and the helix arms are electrically isolated from the ground.

3. The antenna of claim 2 wherein the helix arms are connected with coupler means for feeding RF signals to each one with the same amplitude and quadrature phase difference between adjacent helix arms.

4. The antenna of claim 1 wherein the helix arms and parasitic elements are supported by application to a flat support sheet which is thereafter formed into a cylinder.

5. The antenna of claim 4 wherein a pitch of the helix arms and parasitic elements on the flat support sheet is from 40 to 60 degrees from a bottom edge of the support sheet to be joined to the base plate.

6. The antenna of claim 1 wherein the length of the helix arms and the parasitic elements is 0.5 to 0.7 turns about the cylindrical space.

7. The antenna of claim 1 wherein the length of the helix arms and parasitic elements is less than half a wavelength of signals input to the helix arms.

8. The antenna of claim 1 wherein the length of the helix arms and parasitic elements is less than helical radiating arms of a helical quadrafilar antenna.

9. The antenna of claim 1 wherein the coupler means are electrically isolated from the ground and supported on a top surface of the base plate.

10. The antenna of claim 1 wherein each of the helix arms and parasitic elements comprise a parallel LC circuit intersecting and electrically connecting the lengths of the helix arms and parasitic elements at the same elevation from the base plate.

11. The antenna of claim 1 wherein each of the helix arms and parasitic elements comprise an electric circuit switch intersecting and electrically connecting the lengths of the helix arms and parasitic elements at the same elevation from the base plate, so that only a higher frequency band fed to the helix arms is radiated from a full length of the helix arms.

* * * * *